US006165040A

United States Patent [19]

Burich

[11] Patent Number: 6,165,040

[45] Date of Patent: Dec. 26, 2000

[54] LOOPA TUNE

[76] Inventor: Don Burich, 10322 Monarch Dr., St. Louis, Mo. 63136

[21] Appl. No.: 09/300,608

[22] Filed: Apr. 26, 1999

[51] Int. Cl.[7] ..... A63H 1/24

[52] U.S. Cl. ..... 446/242; 446/397; 84/330

[58] Field of Search ..... 446/26, 28, 236, 446/242, 245, 397, 408, 409, 213, 215, 252; 84/335, 420, 330, 375, 361, 402, 404

[56] References Cited

U.S. PATENT DOCUMENTS

| | | | |
|---|---|---|---|
| 3,282,144 | 11/1966 | Knott | 84/330 |
| 3,327,579 | 6/1967 | Brimhall | 84/330 |
| 4,006,556 | 2/1977 | Williams | 46/228 |
| 4,100,697 | 7/1978 | Ward | 46/269 |
| 4,327,518 | 5/1982 | Knauff | 46/228 |
| 4,380,885 | 4/1983 | Domagata | 46/220 |
| 4,568,303 | 2/1986 | Brown | 446/242 |
| 4,915,666 | 4/1990 | Maleyko | 446/242 |
| 5,108,340 | 4/1992 | Farrow | 446/242 |
| 5,145,443 | 9/1992 | Vaisnys | 446/242 |

FOREIGN PATENT DOCUMENTS

| | | | |
|---|---|---|---|
| 2040707 | 9/1980 | United Kingdom | 84/330 |

*Primary Examiner*—Sam Rimell
*Attorney, Agent, or Firm*—John D. Gugliotta

[57] ABSTRACT

A musical entertainment device is provided having a hoop which plays a musical tune as the user spins it around his/her waist. Inside of the hoop are located a series of pneumatic tone generators or reeds. As the user spins the hoop around his/her waist, diaphragms are compressed by the waist of the user, forcing air through the corresponding tone generators and emitting the notes that comprise the specific tune to be played.

7 Claims, 5 Drawing Sheets

LOOPA TUNE

RELATED APPLICATIONS AND DISCLOSURES

The present invention was first disclosed in the Disclosure Document filed on Aug. 21, 1998. There have been no previously filed, nor any co-pending applications, anywhere in the world.

BACKGROUND OF THE INVENTION

1. Field of the Invention

The present invention relates generally to toy devices, and, more particularly, to a musical entertainment device.

2. Description of the Related Art

Over the years, there have been literally thousands of leisure time toys and other devices on the market, most of which encounter only brief stints of popularity. However, several of these products have achieved legendary status in which their timeless popularity will ensure commercial success for a great deal of time to come. The Frisbee®, Nerf® balls and the Slinky® are but a few examples of these types of items. In response to the vast popularity of these items, there have been several instances in which improvements to the concepts and basic design of these items has resulted in products of substantial commercial success.

A prime example of this phenomena is the ring-type flying discs that were inspired by the Frisbee® concept. Children have a tendency to become quickly bored with a particular game or toy. Accordingly, there is a constant need for new and innovative products that expand on the functionality and enjoyableness of these long-proven products.

In the related art, several devices are disclosed that describe a musical and illuminating HULA HOOP (™) exercising device. These include U.S. Pat. No. 5,108,340, issued in the name of Farrow, and U.S. Pat. No. 4,100,697, issued in the name of Ward.

Several patents disclose an illuminating HULA HOOP (™) device. These include U.S. Pat. No. 4,915,666, issued in the name of Maleyko, and U.S. Pat. No. 4,006,556, issued in the name of Williams.

Several patents disclose a musical and illuminating rotating toy. These include U.S. Pat. No. 4,568,303, issued in the name of Brown, and U.S. Pat. No. 4,327,518, issued in the name of Knauff.

U.S. Pat. No. 5,145,443, issued in the name of Vaisnys et al., discloses a toy hoop with an integrated sound generating device.

U.S. Pat. No. 4,380,885, issued in the name of Komagata, describes a HULA HOOP (™) toy and method of construction.

A search of the prior art did not disclose any patents that anticipate directly many features of the instant invention. Consequently, a need has been felt for providing a new and improved musical HULA HOOP (™) toy.

SUMMARY OF THE INVENTION

It is therefore an object of the present invention to provide an improved musical entertainment device which improves upon the device commonly known as a HULA HOOP (™) by providing a series of passive adjustable openings similar to a reed instrument, which emits musical notes which play a designated tune when the HULA HOOP (™) is played with.

Briefly described according to one embodiment of the present invention, a musical entertainment device is disclosed, which is an improvement upon the device commonly known as a HULA HOOP™. The present invention consists of a hollow hoop, constructed of plastic or similar material, which plays a musical tune as the user spins it around his or her waist.

Inside of the hoop are located a series of pneumatic tone generators or reeds, similar in nature to those found in a child's squeeze toy. The tone generators are driven by a series of air diaphragms located about the interior circumferential surface of the hoop. The tone generators are tuned to different notes and arranged in a sequence such that a musical tune results when played in succession. As the user spins the hoop around his or her waist, the diaphragms will be compressed by the waist of the user, forcing air through the corresponding tone generators and emitting the notes that comprise the specific tune to be played. As a result, depending upon the configuration, a limitless number of tunes can be incorporated into the present invention's design.

It is another object of the present invention to provide a device that generates specific notes as the present invention is played with.

It is another object of the present invention to combine traditional HULA HOOP (™) activity with enjoyment of musical notes.

DESCRIPTIVE KEY

| | | | |
|---|---|---|---|
| 10 | musical entertainment device | 60 | air tube |
| 20 | hoop | 70 | sound emitting hole |
| 30 | tone generator | 80 | direction indicia |
| 40 | reed | 90 | song indicia |
| 50 | air diaphragm | | |

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 5.

1. Detailed Description of the Figures

Figure 1:
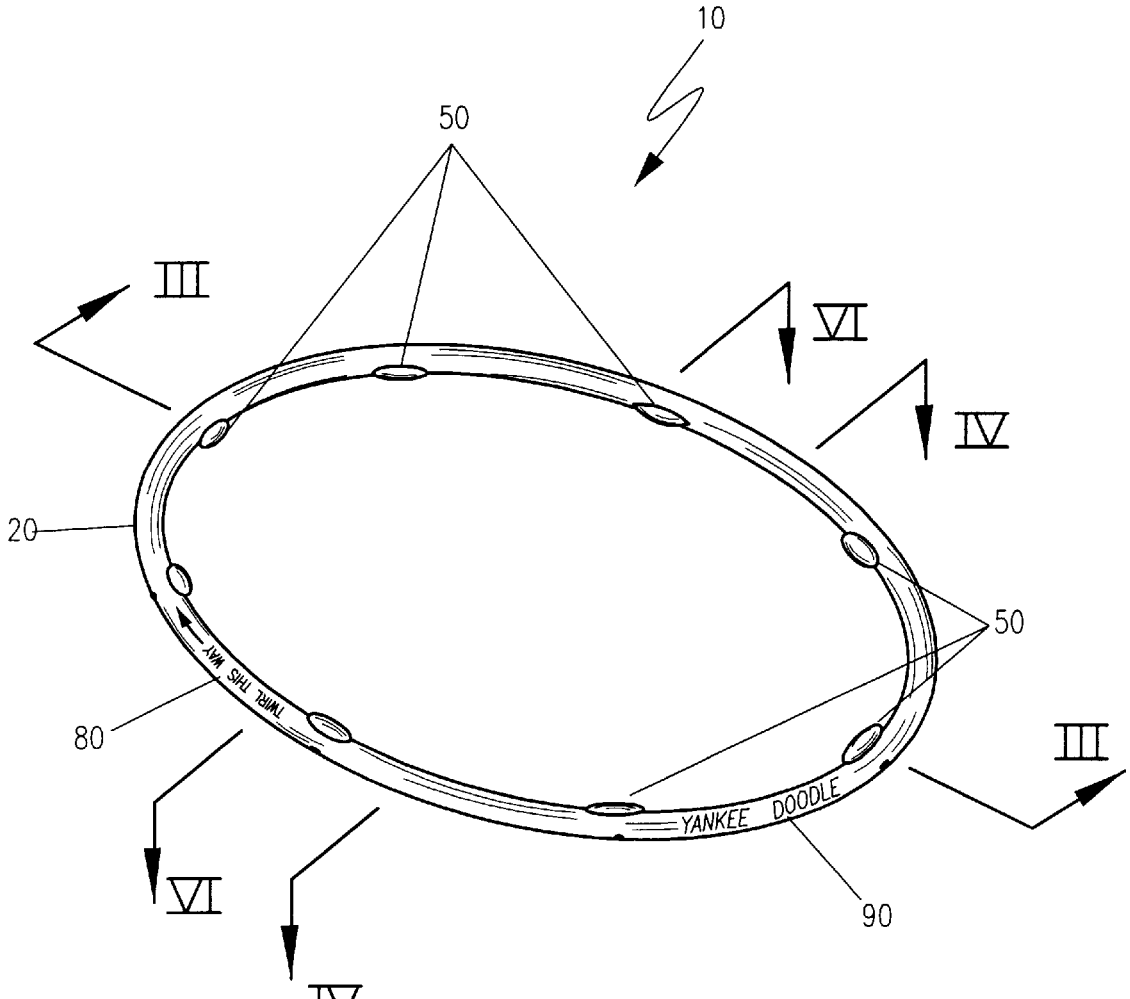
FIG. 1 is a perspective view of the preferred embodiment of musical entertainment device 10.
Figure 2:
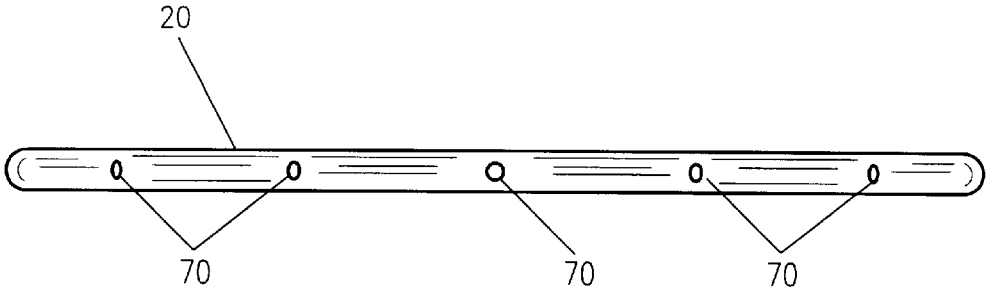
FIG. 2 is a side view thereof.

Referring now to FIGS. 1 and 2, a musical entertainment device 10 is shown, according to the present invention, which is an improvement upon the device commonly known as a HULA HOOP (™). The present invention is constructed of a hollow hoop 20, comprised of plastic or similar material, which plays a musical tune as the user spins it around his or her waist.

Figure 3:
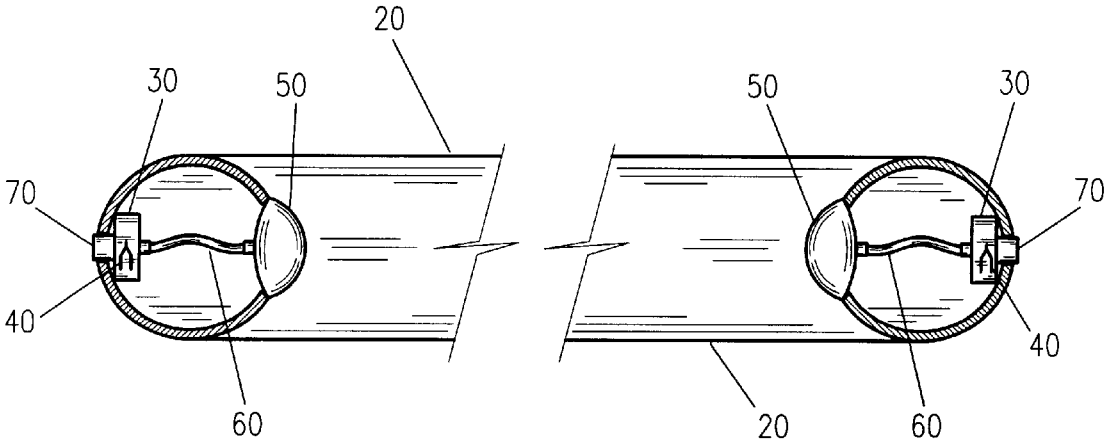
FIG. 3 is a cross sectional view thereof, cut along line III—III of FIG. 1.
Figure 4:
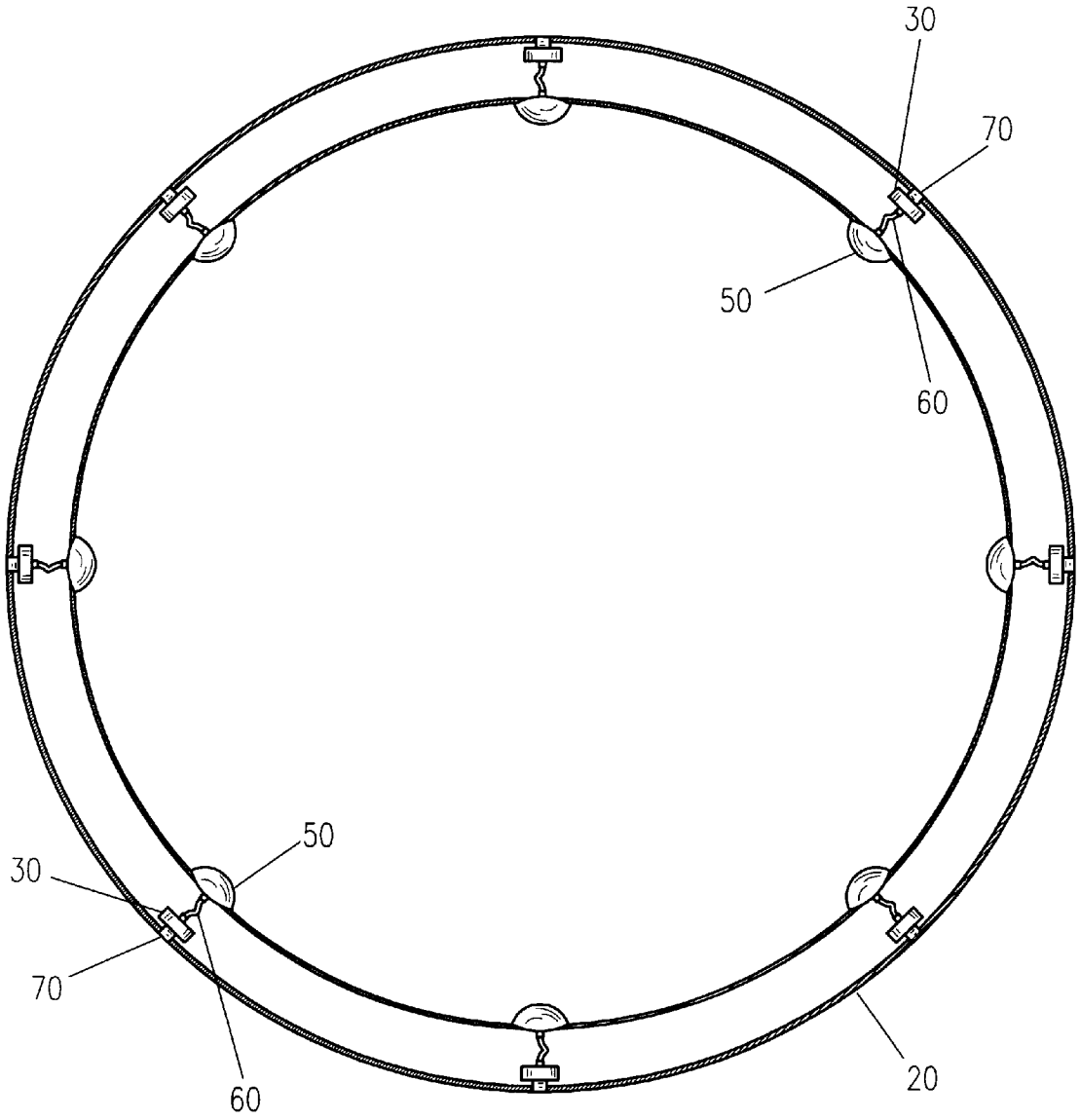
FIG. 4 is a cross sectional view of the preferred embodiment, cut along line IV—IV of FIG. 1.

Referring now to FIGS. 3 and 4, attached to the inside of the hoop 20 are a series of pneumatic tone generators 30, similar in nature to those found in a child's squeeze toy. For purposes of disclosure, the tone generators 30 are depicted as reeds 40, which vibrate to a particular tone when air passes over them.

Each tone generator 30 is pneumatically powered by an air diaphragm 50. The air diaphragms 50 are located about the interior circumferential surface of the hoop 20, on the exterior of the hoop 20, and are designed to come into mechanical interference with the waist of the user during twirling of the hoop 20. One air diaphragm 50 is in fluid communication with at least one tone generator 30. Fluid communication is achieved via an air tube 60. The air tube 60 is connected to both the air diaphragm 50 and the tone generator 30, such that air passing from the air diaphragm 50 activates the tone generator 30, creating a musical tone.

Sound emitting holes 70 are located about the exterior circumferential surface area of the hoop 20, near each tone generator 30. The sound emitting holes 70 also designed to facilitate the inflow of air from the outside atmosphere to the air diaphragms 50 to refill each air diaphragm 50 once it is compressed by the waist of the user. The cross sectional diameter of each sound emitting hole 70 is of sufficient size to permit refill of each air diaphragm 50 in the time it takes for one complete revolution of the hoop 20 around a person's waist.

The tone generators 30 are tuned to varying notes and arranged in a sequence along the internal perimeter surface area of the hoop 20 such that a musical tune results when the tone generators 30 are played in succession.

Figure 5A:
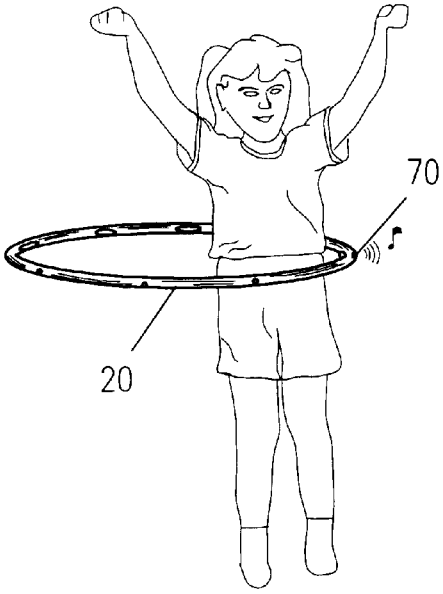
FIG. 5*a*–5*c* are a series of perspective views showing the present invention in use.
Figure 5B:
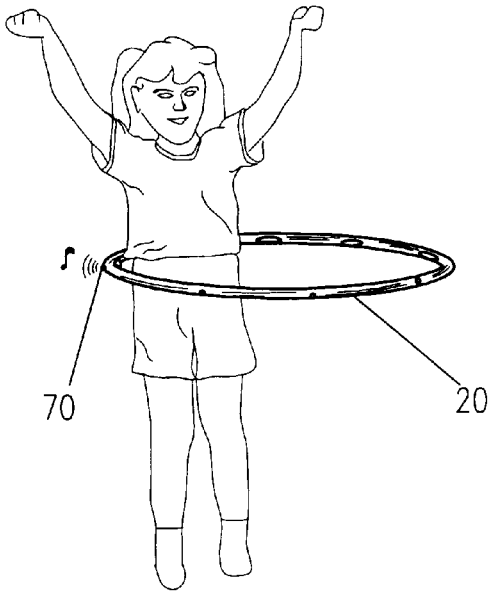
Figure 5C:
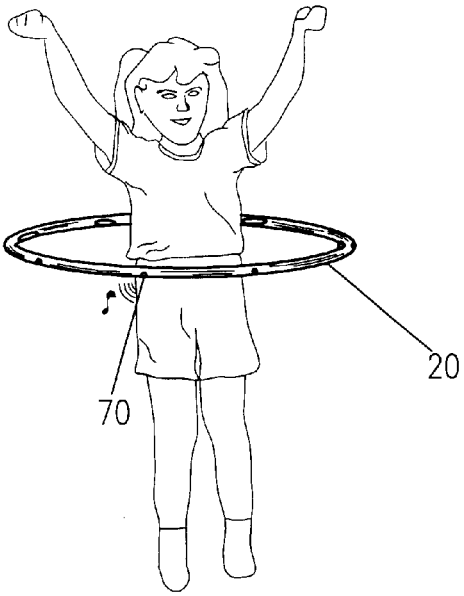

Referring now to FIGS. 5*a*–5*c*, as the user spins the hoop 20 around his or her waist, each air diaphragm 50, in sequence, will be compressed by the waist of the user, forcing air through the corresponding tone generators 30 and emitting the notes that comprise the specific tune to be played through the sound emitting holes 70. As a result, depending upon the configuration, a limitless number of tunes can be incorporated into the present invention's design.

Referring now to FIG. 1, direction indicia 80 are located on the exterior surface of the hoop 20. The direction indicia 80 indicates which direction the hoop 20 should spin in order for the notes to play in the correct sequence, and consequently, the musical tune to play correctly.

For purposes of disclosure, the direction indicia 80 are depicted as an arrow positioned to pointing the direction which the HULA HOOP (™) 20 should be twirled along with the words "twirl in this direction."

Song indicia 90 are located on the external surface of the hoop 20. The song indicia 90 indicates which musical tune is played when the hoop 20 is twirled in the direction indicated by the direction indicia 80. For example, the song indicia 90 may be "yankee doodle" if the song yankee doodle is played when the hoop 20 is twirled.

Figure 6:
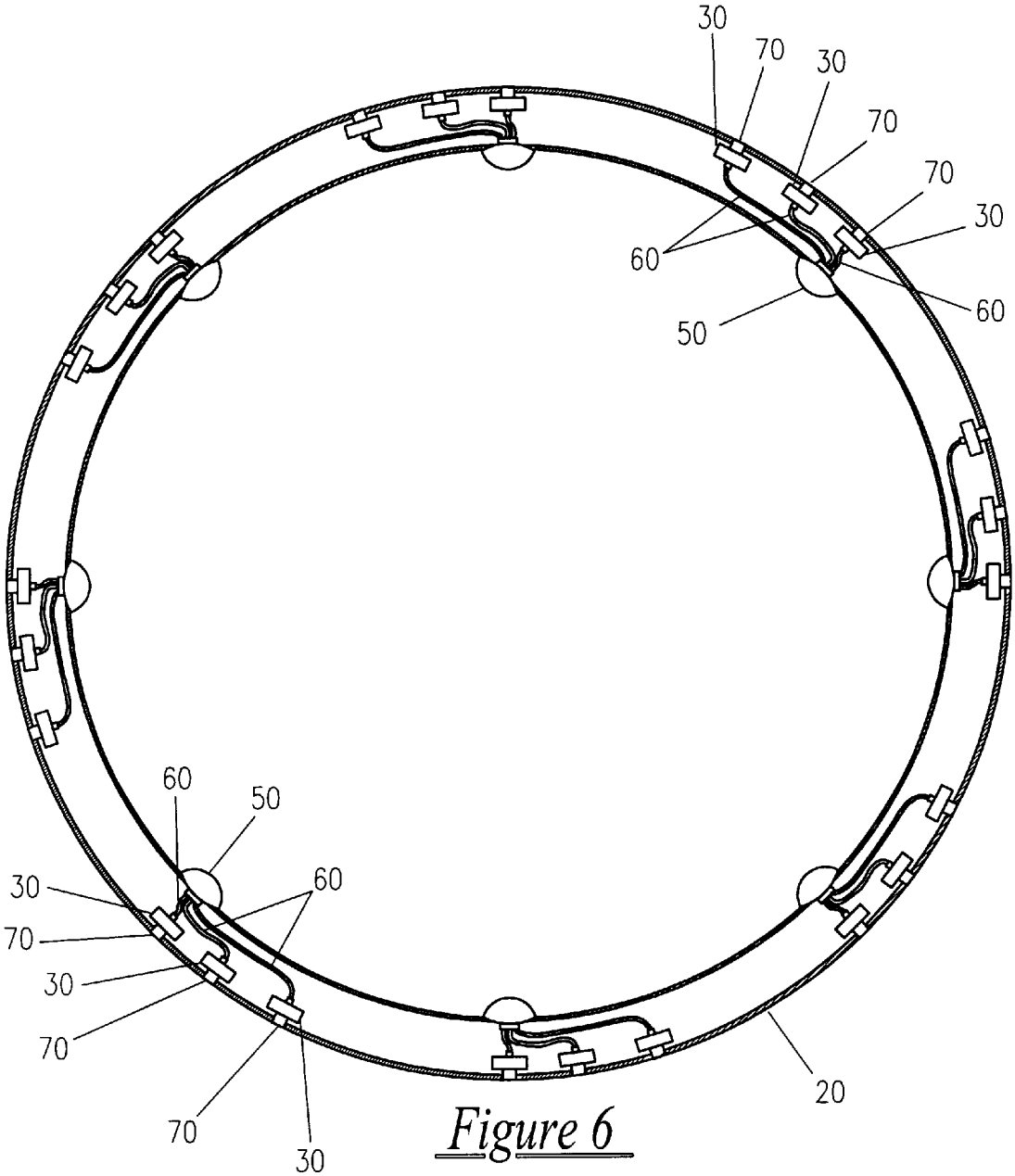
FIG. 6 is cross sectional view of another embodiment cut along lines VI—VI of FIG. 1.

Referring now to FIG. 6, in another embodiment of the present invention, groups of tone generators 30 are in fluid communication with a single air diaphragm 50. The distance each is positioned from the air diaphragm 50 creates a delay in playing of the notes such that the closest tone generator 30 would play first, then the second closest, and so on. This configuration reduces the number of air diaphragms 50 needed and reduces the risk that missing of a single air diaphragm 50 would cause notes not to be played by the corresponding tone generator 30.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

To use the present invention, the operator simply uses the hoop 20 as a traditional HULA HOOP (™) 20, twirling the hoop 20 in the direction indicated by the direction indicia 80. The speed of rotation of the HULA HOOP (™) 20 will determine the speed with which the sequence of notes are emitted and the resulting musical tune is played.

The foregoing description is included to illustrate the operation of the preferred embodiment and is not meant to limit the scope of the invention. The scope of the invention is to be limited only by the following claims.

What is claimed is:

1. A musical entertainment device, comprising:

a hollow hoop, a series of pneumatic tone generators, said pneumatic tone generators attached to the inside of said hoop wherein groups of tone generators are in fluid communication with a single air diaphragm, said air diaphragm located about the interior circumferential surface of the hoop, on the exterior of the hoop, and each air diaphragm being in fluid communication with at least one tone generator;

a plurality of air tubes, said air tubes connecting each tone generator to an air diaphragm; and a series of sound emitting holes, said sound emitting holes located about the exterior circumferential surface area of the hoop, near each tone generator.

2. The musical entertainment device of claim 1, wherein the distance each tone generator is positioned from said air diaphragm creates a delay in playing of the notes.

3. The musical entertainment device described in claim 1, wherein said air diaphragms are configured so as to come into mechanical interference with the waist of a user during twirling of said hoop.

4. The musical entertainment device described in claim 1, wherein said tone generators are reeds, each of which vibrate to a particular predetermined tone when air passes over them.

5. The musical entertainment device described in claim 1, wherein said tone generators are tuned to varying notes and arranged in a sequence along the internal perimeter surface area of the hoop such that a musical phrases results when the tone generators are played in succession.

6. The musical entertainment device described in claim 5, wherein as the user spins the hoop around his or her waist, each air diaphragm, in sequence, will be compressed by the waist of the user, forcing air through the corresponding tone generators and emitting the notes that comprise the specific tune to be released through the sound emitting holes.

7. The musical entertainment device described in claim 1, wherein said musical entertainment device further comprises direction indicia, said direction indicia located on an exterior surface area of said hoop.

* * * * *